US007125599B2

(12) United States Patent
Saldarelli et al.

(10) Patent No.: US 7,125,599 B2
(45) Date of Patent: Oct. 24, 2006

(54) PLATFORM HAVING A NON-SLIP FINISH

(75) Inventors: Thomas A. Saldarelli, Yorktown Heights, NY (US); Jerry R. Amato, Yorktown Heights, NY (US); Matthew D. Cathone, Poughkeepsie, NY (US)

(73) Assignee: Paragon Aquatics, division of Pentair Pool Products, Inc., Lagrangeville, NY (US)

( * ) Notice: Subject to any disclaimer, the term of this patent is extended or adjusted under 35 U.S.C. 154(b) by 0 days.

(21) Appl. No.: 10/287,614

(22) Filed: Nov. 4, 2002

(65) Prior Publication Data

US 2004/0086693 A1 May 6, 2004

(51) Int. Cl.
*D06N 7/04* (2006.01)
*E04H 4/00* (2006.01)

(52) U.S. Cl. ..... 428/141; 428/143; 4/488; 4/496

(58) Field of Classification Search ..... 4/582, 4/488, 496, 504, 631, 637, 640, 656; 428/141, 428/143; 482/30–32; D21/802; 405/4; 114/44–46, 263–267
See application file for complete search history.

(56) References Cited

U.S. PATENT DOCUMENTS 2,963,188 A * 12/1960 Palermo ..... 215/12.2
3,035,837 A * 5/1962 Austin ..... 482/30
3,942,199 A * 3/1976 Kollsman ..... 4/583
3,964,221 A 6/1976 Berquist
4,243,696 A * 1/1981 Toth ..... 427/474
4,303,238 A * 12/1981 Rude ..... 482/30
4,336,293 A * 6/1982 Eiden ..... 428/143
4,931,330 A * 6/1990 Stier et al. ..... 428/41.5
5,009,045 A 4/1991 Yoder
5,400,556 A 3/1995 Favaron
5,417,167 A 5/1995 Sadr
5,475,951 A * 12/1995 Litzow ..... 52/177
5,620,552 A 4/1997 Denney
5,713,165 A 2/1998 Erwin
5,885,339 A 3/1999 Dorsett
5,916,031 A 6/1999 Casillan
6,216,608 B1 4/2001 Woods et al.
6,218,001 B1 4/2001 Chen et al.
6,479,142 B1 * 11/2002 Condon et al. ..... 428/354
6,523,188 B1 * 2/2003 Kiefer et al. ..... 4/496

* cited by examiner

*Primary Examiner*—Harold Pyon
*Assistant Examiner*—Patricia L Nordmeyer
(74) *Attorney, Agent, or Firm*—Pearne & Gordon LLP

(57) ABSTRACT

A non-slip platform for location adjacent to a body of water providing a person with traction despite the presence of water on the platform, wherein the platform includes an upper portion; a fluid-draining topography at the upper portion that channels the water to minimize water contact with the person on the platform; and a non-slip surface coating on the fluid-draining topography for traction, said non-slip surface coating including an abrasive layer. The present invention is also directed to a method of making the non-slip platform for location adjacent to a body of water, the method including the steps of forming a fluid-draining topography at the upper portion of the non-slip platform, preparing the fluid-draining topography to support an abrasive layer, depositing the abrasive layer on the prepared fluid-draining topography, and providing a topcoat to the fluid-draining topography.

24 Claims, 4 Drawing Sheets

PLATFORM HAVING A NON-SLIP FINISH

BACKGROUND OF THE INVENTION

1. Field of the Invention

The present invention relates generally to non-slip surfaces, and more particularly to platforms having a non-slip surface including a grit finish and a fluid-draining topography, and a method for making said platform.

2. Description of Related Art

Swimming as a form of exercise and competition has become increasingly popular among people of all ages. As the number of contestants increases with the rise in the sport's popularity, swim meets have become ever more competitive. The difference between the winning time and that of the closest competitor is often measured in hundredths of a second. Every aspect of a swimming event has the potential to decide the outcome of the race. A slip during the start of a race will almost certainly ensure a poor finish time. Further, the increase in competition has encouraged competitors to push themselves to the limits of physical ability, resulting in new records being set at many events.

For a pool-based competition, swimmers start a swim race at one end of a pool from atop a starting platform. Starting platforms have generally been comprised of a support and a plate fastened to the upper portion of the support. The surface of the plate on which the swimmers stand is positioned at an angle relative to the deck of the pool. This angle provides the swimmers with suitable support in a lateral direction parallel to the surface of the water to allow for a rapid departure from the platform into the pool at the start of the race. However, water splashed from the pool or dripped from a wet swimmer onto the platform reduces traction on the platform and increases the likelihood of a faulty start. Thus, to further enhance the ability of swimmers to rapidly depart from the starting platform, a non-slip surface at the upper portion of the platform is required by sanctioning bodies of swimming events such as United States Masters Swimming.

Such non-slip surfaces known in the prior art include those that are textured or roughened rubberized surfaces that may include grooves. However, when a sufficient amount of water is present on the non-slip surface, the water rises above the depth of the grooves and reduces the effectiveness of such surfaces. The presence of water between the swimmer and the platform lowers the coefficient of friction of that surface, and leads to reduced traction and a slower starting time.

An alternative non-slip surface having a generally constant coefficient of friction despite the presence of water thereon includes a grit or sandpaper like finish on its upper portion. This type of surface relies on its rough texture to provide increased traction for swimmers on the platform instead of providing separation between the swimmers and the water. Such a surface is typically an adhesively attached sheet of grit finish applied to surfaces where exceptional traction is desired. However, the non-slip materials tend to peel off over time and those which were mechanically fastened to surfaces required additional parts and labor and generally had exposed fasteners.

Thus, there is continued need for improvements to non-slip starting platforms that provide traction despite the presence of water thereon.

At events that occur near a body of water, non-slip surfaces on platforms used by individuals such as lifeguards and race officials, for example, are critical to insure firm footing and efficient performance. Therefore, it follows that a non-slip surface is also desirable in areas adjacent the body of water in addition to at an upper portion of a starting platform.

SUMMARY OF THE PRESENT INVENTION

Briefly, the present invention includes a non-slip platform for location adjacent to a body of water providing a person with traction despite the presence of water on the platform, wherein the platform includes an upper portion; a fluid-draining topography at the upper portion that channels the water to minimize water contact with the person on the platform; and a non-slip surface coating on the fluid-draining topography for traction, said non-slip surface coating including an abrasive layer. The present invention is also directed to a method of making the non-slip platform for location adjacent to a body of water, the method including the steps of forming a fluid-draining topography at the upper portion of the non-slip platform, preparing the fluid-draining topography to support an abrasive layer, depositing the abrasive layer on the prepared fluid-draining topography, and providing a topcoat to the fluid-draining topography.

BRIEF DESCRIPTION OF THE DRAWINGS

The foregoing and other features and advantages of the present invention will become apparent to those skilled in the art to which the present invention relates upon reading the following description with reference to the accompanying drawing, in which.

DETAILED DESCRIPTION OF THE INVENTION

Figure 1:
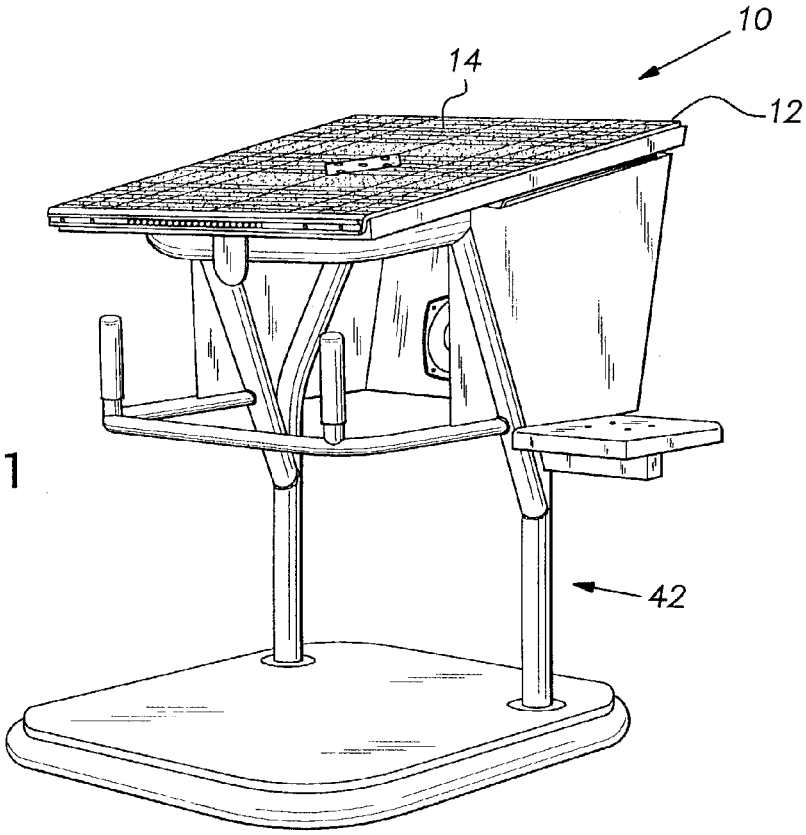
FIG. 1 is a perspective view of a starting platform for use at the start of a swimming race according to an embodiment of the present invention.

Certain terminology is used herein for convenience only and is not to be taken as a limitation on the present invention. Further, in the drawings, the same reference numerals are employed for designating the same elements throughout the ten figures, and in order to clearly and concisely illustrate the present invention, certain features may be shown in somewhat schematic form.

A platform 10, such as a starting platform, having a non-slip surface according to an embodiment of the present invention is illustrated in FIG. 1. The platform 10 includes a plate 12 having an upper portion 14, the plate 12 being supported by a support structure 42 that is positioned adjacent a body of water. Disposed at the upper portion 14 of the plate 12 is a fluid-draining topography 22 (FIG. 2) that minimizes contact between any water on the platform 10 and a person standing thereon. A textured or "grit" finish 18 is disposed on the fluid-draining topography 22 by affixing particulate matter 24 to the fluid-draining topography 22. The combination of the fluid-draining topography 22 and the particulate matter 24 creates a non-slip platform 10 despite the possible presence of water thereon.

Figure 2:
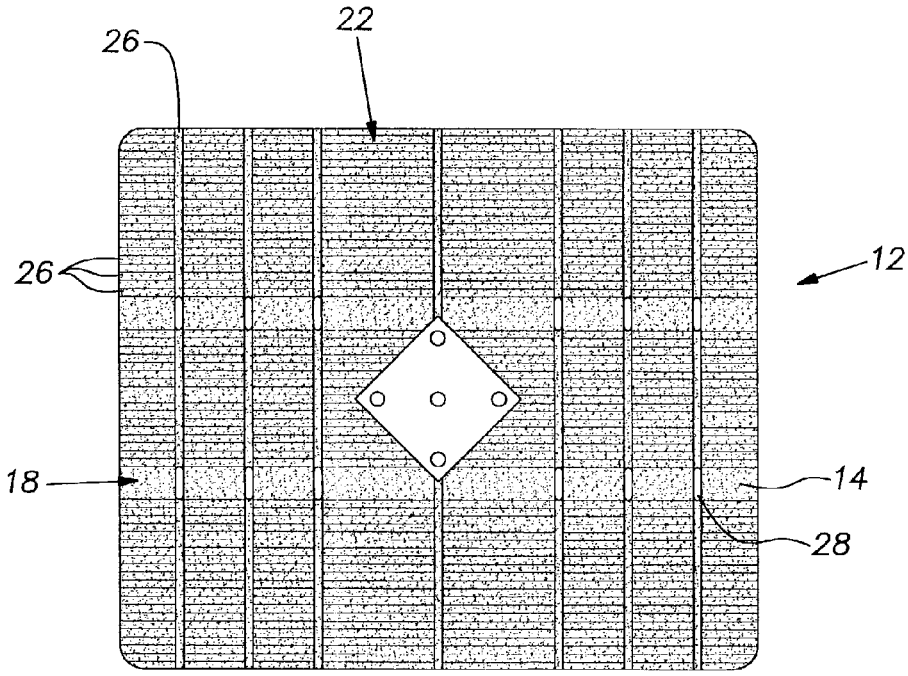
FIG. 2 is a top view of an upper portion of a starting platform having a textured finish on a fluid-draining topography according to an embodiment of the present invention.
Figure 8:
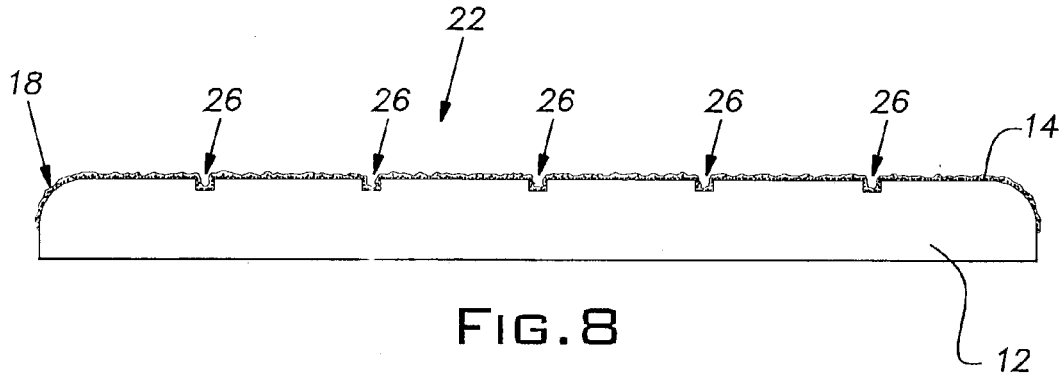
FIG. 8 is a side view of a non-slip surface including the fluid-draining topography and the abrasive texture.
Figure 9:
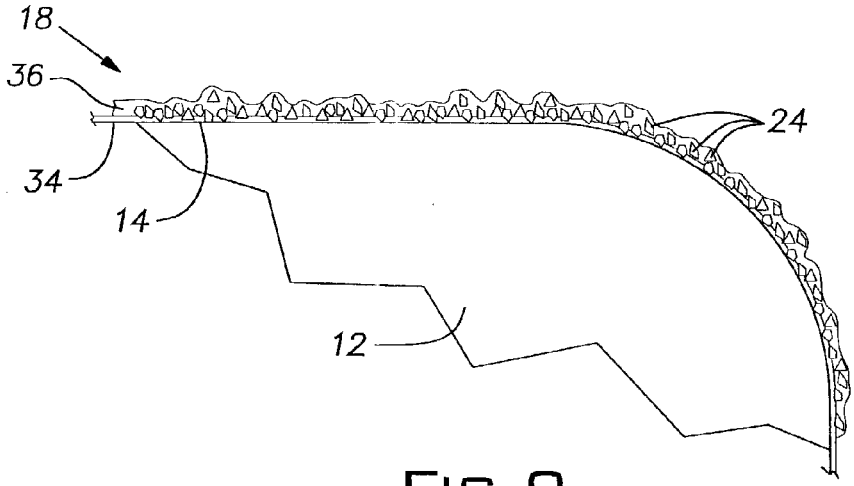
FIG. 9 is a magnified view of a portion of the non-slip surface shown in FIG. 8, the magnified view illustrating the provision of a finishing layer to a fluid-draining topography having an abrasive texture.
Figure 10:
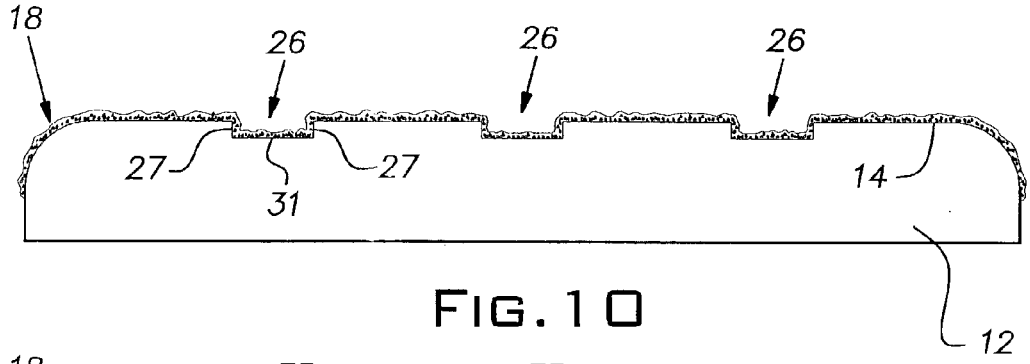
FIG. 10 is an illustration of another embodiment of a non-slip surface according to the present invention.

Referring to FIGS. 2 and 8, the plate 12 includes the fluid-draining topography 22 disposed at the upper portion 14, and the textured finish 18 disposed on the fluid-draining topography 22. The plate 12 is formed from a suitably strong and rigid material such as wood, plastic, or metal, for example, capable of supporting the weight of a person. The dimensions of the plate 12 may vary according to the desired use, however, plates 12 used in the construct of starting platforms are typically required to be at least 1 foot 8 inches square, for example. Different sanctioning bodies that govern pool-based competitions may require plates 12 having different minimum dimensions.

Channels 26 formed at the upper portion 14 of the plate 12 form the fluid-draining topography 22. The channels 26 may extend horizontally, vertically, or both horizontally and vertically across the upper portion 14, as illustrated in FIG. 2. Channels may also extend in a variety of geometric and other patterns, and diagonally across the upper portion 14 without departing from the scope of the present invention. Despite their orientation at the upper portion 14, the channels 26 are adapted to collect any water that would otherwise collect on the plate 12 and prevent the level of the channeled water from rising to an uppermost surface of the upper portion 14. Water collected in the channels 26 flows therein until the water reaches an outer perimeter of the plate 12 where the water is drained from the plate 12. As more water reaches the upper portion 14 of the plate 12, the volume of water draining from the channels 26 increases such that the water level in the channels 26 never rises to a height that is greater than or equal to the height of the uppermost surface of the upper portion 14.

An alternative embodiment of the present invention includes channels 26 adapted to drain water at a location other than at the outer perimeter of the plate 12. For example, the plate 12 may include a contour that causes water to flow in the channels 26 toward a draining location located near the center of the plate 12. Or, yet another embodiment includes channels 26 wherein water flows in the channels 26 toward a draining location located between the center and the outer periphery of the plate 12.

Additional draining means, such as a hole 28, for example, may be positioned along a bottom surface 31 of the channels 26 according to an alternate embodiment of the present invention. The hole 28 allows water to drain from the channels 26 at an additional location other than at the locations discussed above. Thus, a greater volume of water may be more rapidly removed from the upper portion 14 than is possible by draining water only at the perimeter of the plate 12.

Figure 5:
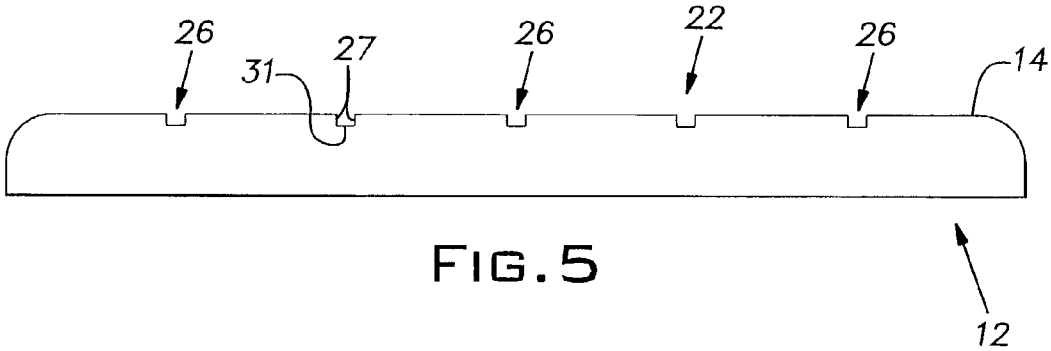
FIG. 5 is a side view of a plate having one configuration of a fluid-draining topography at an upper portion thereof.

The channels 26, according to an embodiment of the platform 10 illustrated in FIG. 5, are square shaped channels 26. Each channel 26 includes two generally vertical side walls 27 that define the depth of the channel 26 and the bottom surface 31 that defines the width of the channel 26. The side walls 27 are disposed at opposite sides of the bottom surface 31 and create a pathway that directs the flow of water. A specific embodiment of the present invention includes channels 26 having a depth of 9/64 in. and a width of 1/4 in. However, the present invention also encompasses a fluid-draining topography 22 having channels 26 of any suitable dimensions that permit the channeling of any water from atop the upper portion 14 of the plate 12.

Figure 11:
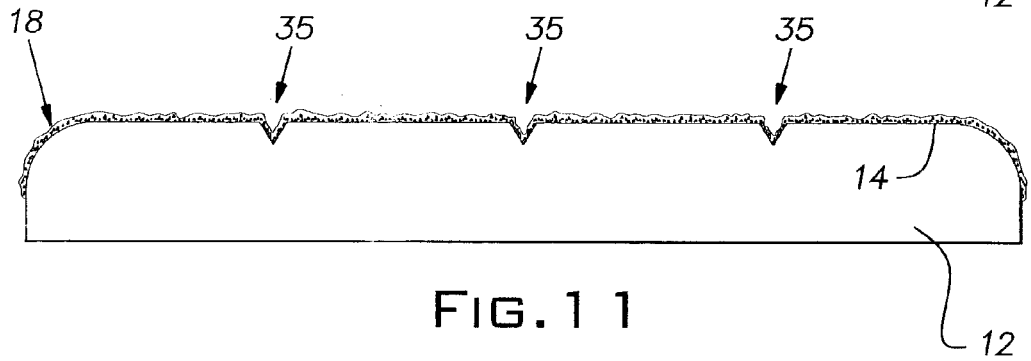
FIG. 11 is an illustration of yet another embodiment of a non-slip surface according to the present invention.

Further embodiments of the present invention include channels 26 in a variety of suitable shapes that are capable of channeling water. An embodiment of a fluid-draining topography 22 having generally V-shaped channels 35 is illustrated in FIG. 11, and generally U-shaped channels (not shown) will also suffice to channel any water from the upper portion 14 of the plate 12. In any of these alternative embodiments, a hole (not shown) may be formed in the channels 26, just as before, wherein the hole is formed in a bottom portion of the channels 26.

The textured finish 18 of the fluid-draining topography 22 includes particulate matter 24 that provides the fluid-draining topography 22 with enhanced non-slip properties. According to one embodiment of the present invention, the particulate matter 24 is applied to the fluid-draining topography 22 between an adhesion promoting coating 34 and a topcoat 36, however, the particulate matter 24 may be provided adjacent to any element of the non-slip platform 10. The adhesion promoting coating 34 promotes adhesion between the plate 12, the particulate matter 24, and the topcoat 36. One or more conventional primers such as DX 801 plastic primer, EPX 900/901 epoxy primer, and AUE 100/101 acrylic urethane paint, all manufactured by PPG Industries, Inc., for example, are applied to the fluid-draining topography 22 and included in the adhesion promoting coating 34.

Figure 6:
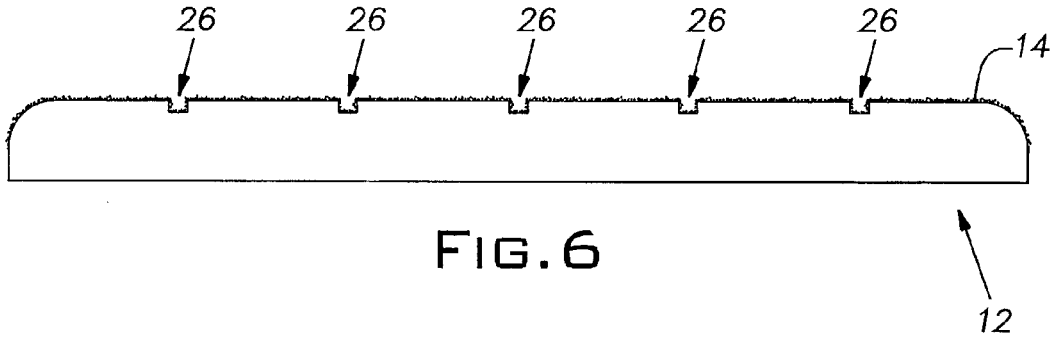
FIG. 6 is a side view of a plate with an abrasive texture provided on the fluid-draining topography shown in FIG. 5.
Figure 7:
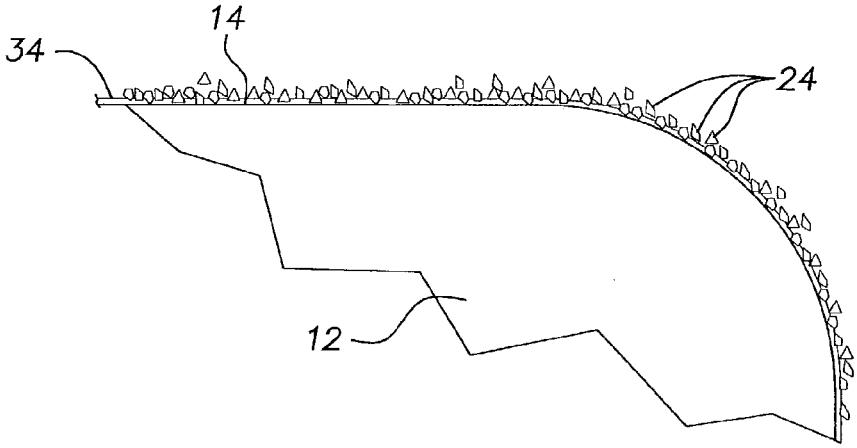
FIG. 7 is a magnified view of a portion of the plate having an abrasive texture on the fluid-draining topography shown in FIG. 6.

Fine particles of any suitable material that is chemically resistant to the other materials used in the manufacture of the present invention are suitable for use as the particulate matter 24 in the creation of the textured finish 18. Examples of suitable materials that may be used as the particulate matter 24 include materials such as aluminum oxide, crystalline silica, aluminum silica, titanium oxide and all derivatives thereof, zinc oxide, topaz, silicon carbide, boron nitride, or mixtures of two or more thereof, for example. As illustrated in FIGS. 6 and 7, the particulate matter 24 is distributed generally evenly over the primed fluid-draining topography 22 such that the particulate matter 24 forms randomly oriented protrusions extending outwardly from the exposed surfaces of the fluid-draining topography 22. The random orientation of the particulate matter 24 provides a person on the platform 10 with a plurality of gripping surfaces that engage the person's foot in any lateral direction parallel with the plane of the plate 12. Thus, the particulate matter 24 covers the fluid-draining topography 22 to provide traction in all lateral directions to anyone standing on the platform 10 despite the possible presence of water thereon.

The finish coating 36 is applied to the textured finish 18 to encapsulate the particulate matter 24 and prevent it from flaking off of the fluid-draining topography 22. Suitable coatings such as acrylic urethane paint, for example, like AUE 100/101 Acrylic Urethane Paint manufactured by PPG Industries, Inc., may be used for the topcoat 36.

Figure 3:
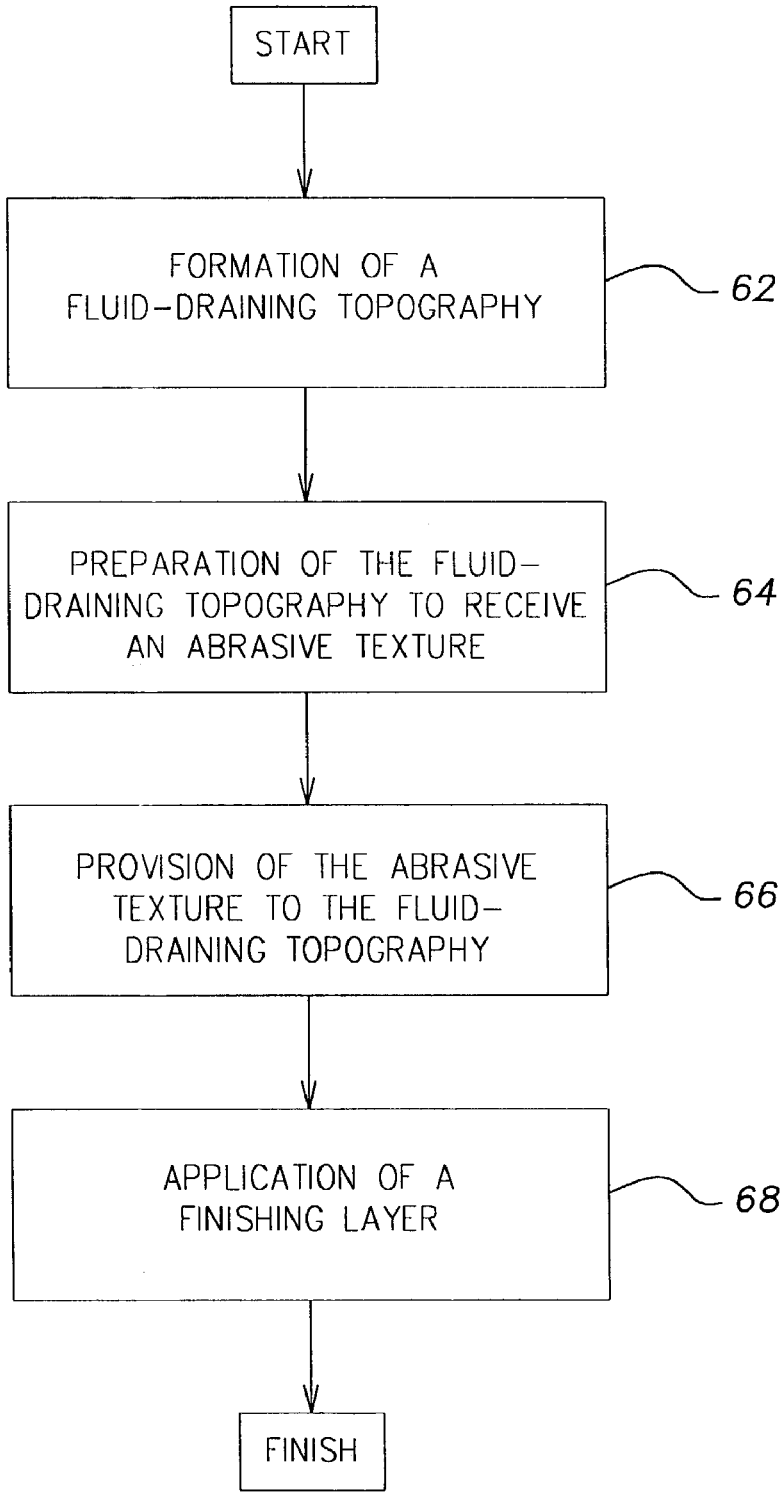
FIG. 3 is a flow chart illustrating the steps of the method according to the present invention.
Figure 4:
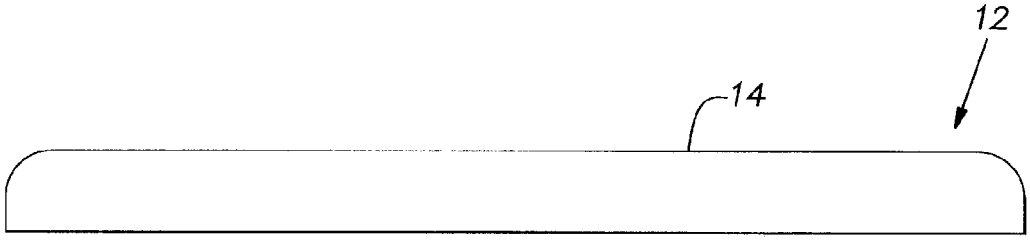
FIG. 4 is a side view of a plate shown before the formation of the fluid-draining topography.

FIG. 3 is a flowchart illustrating a method of manufacturing the non-slip platform 10 according to the present invention. In accordance with this method, the fluid-draining topography 22 is first formed at the upper portion 14 of the plate 12 as at step 62. Forming the fluid-draining topography 22 may be accomplished in a variety of methods according to the present invention. The fluid-draining topography 22 may be formed by integrally molding the plate 12 to include the fluid-draining topography 22 at its upper portion 14; by performing cutting, grinding, or equivalent mechanical etching techniques on a generally flat plate 12 formed without the fluid-draining topography 22; chemically etching channels into the upper portion 14 of the plate 12; or even by fastening rigid members (not shown) to a generally flat upper portion 14 forming channels 26 in between the rigid members, for example. FIG. 5 illustrates a plate 12 after completion of this step of the method according to the present invention.

After the fluid-draining topography 22 is formed, it is prepared to receive the textured finish 18 in step 64 of FIG. 3. The preparation step 64 includes first the step of scuffing the fluid-draining topography 22 with an abrasive material, such as a sanding paste, for example, to lightly abrade the exposed surface of the fluid-draining topography 22. Abrading the fluid-draining topography 22 exposes a large surface area that strengthens the adhesion of subsequently applied materials and removes any foreign objects on the upper portion 14.

The plate 12 is washed following the abrasion of the fluid-draining topography 22. Washing the plate 12 removes residual traces of the abrasive material used to abrade the fluid-draining topography 22. A mild soap with warm water is used in one embodiment of the method of the present invention to wash the plate 12. After washing, the plate 12 should be allowed to dry. Soap or water remaining on the plate 12 will interfere with the bond between the plate 12 and subsequently applied materials. The length of time it takes for the plate 12 to dry will vary depending upon the ambient conditions.

Further according to the step 64 of preparing the fluid-draining topography 22 to receive the textured finish 18, any oil or water remaining on the fluid-draining topography 22 must be removed. A suitable cleaning solution, such as an alcohol based cleaner, for example, is used for this step. An example of such a cleaner is that commercially available under the tradename DX 103 from PPG Industries, Inc. Once again, ample time is allotted to allow the fluid-draining topography 22 to dry after removing oil and water from the fluid-draining topography 22 with the cleaning solution.

Once the fluid-draining topography 22 is free of foreign matter, including oil and water, the adhesion promoting coating 34 is applied to the fluid-draining topography 22 as part of the preparation step 64. The adhesion promoting coating 34 includes materials that promote the bond between the plate 12 and the other elements that, together, form the non-slip finish of the present invention. The first component of the adhesion promoting coating 34 is a first primer that promotes the bond between the plate 12 and subsequently applied materials. A commercially available primer, such as DX 801 from PPG Industries, Inc., for example, is applied and allowed to dry for a suitable length of time. For the embodiment of the present invention using DX 801 as the first primer, a 0.001 in. wet coat should be allowed to dry approximately 30 minutes at room temperature. However, the first primer can also be any adhesion promoter that will strengthen the bond between the plate 12 material and subsequently applied materials. The first primer is applied using a wide variety of alternate methods that provide a generally uniform application of the first primer. Alternative embodiments of the present invention include spraying or brushing on the first primer, or immersing the plate 12 in a bath of the first primer layer material.

Since the plate 12 may be fabricated from materials other than a plastic without departing from the scope of the present invention, the first primer is chosen such that the first primer will strengthen the adhesion between the specific plate 12 material and subsequently applied materials.

Application of a second primer is included in step 64 to further strengthen the bond between the plate 12 and subsequently applied materials, and particularly, the bond between the plate 12 and the topcoat 36. An example of a suitable second primer used in an embodiment of the present invention is PPG Industries, Inc.'s EPX 900/901 Epoxy Primer. The second primer is applied in any manner similar to those used to apply the first primer to provide a generally uniform coat of the second primer. An embodiment of the present invention includes the application of a 0.002 to 0.003 in. wet coat of the EPX 900/901 Epoxy Primer and allowing it to dry for approximately one hour after its application at room temperature.

Formation of the adhesion promoting coating 34 further includes applying a paint to the fluid-draining topography 22, wherein the paint enhances the bond of the topcoat 36 to the materials applied to this point in the method. Specifically, the paint strengthens the bond between the topcoat 36 and the fluid-draining topography 22 in locations on the fluid-draining topography 22 not supporting particulate matter 24. When the topcoat 36 is applied over the fluid-draining topography 22 having the particulate matter 24 distributed thereon, the topcoat 36 will blanket the particulate matter 24 and adhere to the exposed surfaces of the fluid-draining topography 22 adjacent to the particulate matter 24. Thus, the particulate matter 24 is encapsulated on the fluid-draining topography 22. An example of a suitable paint application according to an embodiment of the present invention is a 0.0035 to 0.0045 in. wet application of AUE 100/101 Acrylic Urethane Paint #8000-124 white produced by PPG Industries, Inc. However, it is appreciated that any paint, including water or solvent based paints, for example, that provide a suitably strong bonding surface for the application of the topcoat 36 may be used.

After the fluid-draining topography 22 has been prepared, the particulate matter 24 forming the textured finish 18 is affixed to the fluid-draining topography 22 as step 66 in FIG. 3. The particulate matter 24 is provided on the prepared fluid-fluid draining topography 22 in a manner that provides generally uniform coverage of the fluid-draining topography 22. Excess particulate matter 24, that is, particulate matter 24 resting on top of particulate matter 24 instead of adhering to the adhesion promoting coating 34, is removed. Removal of the excess particulate matter 24 is accomplished using any method capable of selectively removing the excess particulate matter 24 without removing the particulate matter 24 adhered to the adhesion promoting coating 34. Such removal techniques include blowing off excess particulate matter 24 with a compressed gas, or angling or inverting the plate 12 having the fluid-draining topography 22 and allowing gravity to remove the excess particulate matter 24, for example. According to another embodiment of the present invention, excess particulate matter 24 is removed by blowing compressed air at the fluid-draining topography 22 at a pressure that is no greater than 5 psi.

A topcoat 36 encapsulates the particulate matter 24 and holds it in place on the fluid-draining topography 22. Application of the topcoat 36 is step 68 in FIG. 3, and includes the steps of applying successive coats of a suitable finishing agent as needed to encapsulate the particulate matter 24. Examples of such finishing agents include urethanes and paints, but also include any substance capable of encapsulating the particulate matter 24 when wet and providing support to the particulate matter 24 when dry. A specific embodiment of the present invention includes a 0.0045 to 0.006 in. wet coat of an acrylic urethane paint like that sold by PPG Industries, Inc. under the tradename AUE 100/101#8000-124 white. To determine whether an additional application of the finishing agent is needed, the degree of coverage of the particulate matter 24 must be observed. Succeeding applications of the finishing agent are needed until the topcoat 36 forms a generally uniform finish, minimizing the exposed portions of the particulate matter 24. Unless such a generally uniform finish exists, additional coats of the finishing agent are applied, after allowing the previously applied coat to begin drying, until the finishing agent generally surrounds the particulate matter 24. While providing the non-slip platform 10 with a uniform finish, further coats of the finishing agent are applied one at a time allowing each coat to dry before applying a subsequent coat.

While the invention has been described with reference to certain preferred embodiments, as will be apparent to those skilled in the art, certain changes and modifications can be made without departing from the scope of the invention as defined by the following claims.

What is claimed is:

1. A non-slip swimmer starting platform including:

a rigid plate for supporting the weight of a swimmer, the ridge plate including an upper portion having a solid surface;

a support structure for supporting the rigid plate at an elevated location adjacent to a body of water;

the solid surface of the upper portion has a fluid-draining topography including at least one channel extending along the upper portion; and a non-slip surface coating on the entire fluid-draining topography, said non-slip surface coating including an abrasive layer.

2. The non-slip platform according to claim 1, wherein the abrasive layer includes particulate matter located on top of the fluid-draining topography and adhered to the fluid-draining topography between an adhesion promoting layer and a topcoat.

3. The non-slip platform according to claim 1, wherein the fluid-draining topography includes plural channels at the upper portion, the channels adapted to channel a fluid from atop the upper portion and, said non-slip surface coating extends into the channels.

4. The non-slip platform according to claim 1 further including a hole formed in a lower surface of the channel.

5. The non-slip platform according to claim 1, wherein the support structure supports the rigid plate at an inclination.

6. A non-slip swimmer starting platform for location adjacent to a body of water providing a swimmer with traction despite the presence of water on the platform, the platform including:

a rigid plate for supporting the weight of the swimmer, the ridge plate including an upper portion having a solid surface;

a support structure for supporting the rigid plate at an elevated location adjacent to a body of water;

the solid surface of the upper portion has a fluid-draining topography including at least one channel extending along the upper portion that channels the water to minimize water contact with the person on the platform; and a non-slip surface coating on the entire fluid-draining topography for traction, said non-slip surface coating including an abrasive layer.

7. The non-slip platform according to claim 6, wherein the abrasive layer includes particulate matter located on top of the fluid-draining topography and adhered to the fluid-draining topography by an adhesion promoting layer and a topcoat.

8. The non-slip platform according to claim 6 further including a hole formed in a lower surface of the channel.

9. The non-slip platform according to claim 6, wherein the support structure supports the rigid plate at an inclination.

10. The non-slip platform according to claim 6, wherein the fluid-draining topography includes plural channels formed at the upper portion, the channels adapted to channel a fluid from atop the upper portion and, said non-slip surface coating extends into the channels.

11. The non-slip platform according to claim 10, wherein the channel has a generally rectangular cross sectional shape.

12. The non-slip platform according to claim 10, wherein the channel has a generally triangular cross sectional shape.

13. A non-slip swimmer starting platform including:

a rigid, unitary plate for supporting the weight of a swimmer, the ridge plate having an upper portion with a solid surface;

a support structure for supporting the rigid plate at an elevated location adjacent to a body of water;

the solid surface of the upper portion has a fluid-draining topography including at least one channel extending along the upper portion; and a non-slip surface coating on the fluid-draining topography, said non-slip surface coating including an abrasive layer.

14. The non-slip platform according to claim 13, wherein the abrasive layer includes particulate matter located on top of the fluid-draining topography and adhered to the fluid-draining topography between an adhesion promoting layer and a topcoat.

15. The non-slip platform according to claim 13, wherein the fluid-draining topography includes plural channels formed at the upper portion, the channels adapted to channel a fluid from atop the upper portion and, said non-slip surface coating extends into the channels.

16. A non-slip swimmer starting platform for location adjacent to a body of water providing a swimmer with traction despite the presence of water on the platform, the platform including:

a rigid, unitary plate for supporting the weight of the swimmer, the ridge plate having an upper portion with a solid surface;

a support structure for supporting the rigid plate at an elevated location adjacent to a body of water;

the solid surface of the upper portion has a fluid-draining topography including at least one channel extending along the upper portion that channels the water to minimize water contact with the person on the platform; and a non-slip surface coating on the fluid-draining topography for traction, said non-slip surface coating including an abrasive layer.

17. The non-slip platform according to claim 16, wherein the abrasive layer includes particulate matter located on top of the fluid-draining topography and adhered to the fluid-draining topography by an adhesion promoting layer and a topcoat.

18. A non-slip, non-flexing swimmer starting platform including:

a rigid plate for supporting the weight of a swimmer, the ridge plate having an upper portion with a solid surface;

a support structure for supporting the rigid plate at an elevated location adjacent to a body of water;

the solid surface of the portion has a fluid-draining topography including at least one channel extending along the upper portion; and a non-slip surface coating on the fluid-draining topography, said non-slip surface coating including an abrasive layer.

19. The non-slip platform according to claim 18, wherein the abrasive layer includes particulate matter located on top of the fluid-draining topography and adhered to the fluid-draining topography between an adhesion promoting layer and a topcoat.

20. The non-slip platform according to claim 18, wherein the fluid-draining topography includes plural channels formed at the upper portion, the channels adapted to channel a fluid from atop the upper portion and, said non-slip surface coating extends into the channels.

21. The non-slip platform according to claim 18 further including a hole formed in a lower surface of the channel.

22. A non-slip, non-flexing swimmer starting platform for location adjacent to a body of water providing a swimmer with traction despite the presence of water on the platform, the platform including:

a rigid plate for supporting the weight of a swimmer, the ridge plate having an upper portion with a solid surface;

a support structure for supporting the rigid plate at an elevated location adjacent to a body of water;

the solid surface of the upper portion has a fluid-draining topography including at least one channel extending along the upper portion that channels the water to minimize water contact with the swimmer on the platform; and a non-slip surface coating on the fluid-draining topography for traction, said non-slip surface coating including an abrasive layer.

23. The non-slip platform according to claim 22, wherein the abrasive layer includes particulate matter located on top of the fluid-draining topography and adhered to the fluid-draining topography by an adhesion promoting layer and a topcoat.

24. The non-slip platform according to claim 22 further including a hole formed in a lower surface of the channel.

* * * * *